US008758034B1

(12) United States Patent
Shotey et al.

(10) Patent No.: US 8,758,034 B1
(45) Date of Patent: Jun. 24, 2014

(54) TAMPER RESISTANT ELECTRICAL PLUG

(75) Inventors: Marcus J. Shotey, Scottsdale, AZ (US); Jeffrey P. Baldwin, Phoenix, AZ (US); John Klein, Gilbert, AZ (US); Jason Thomas, Mesa, AZ (US); Ryan K. Liebengood, Mesa, AZ (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 13/364,133

(22) Filed: Feb. 1, 2012

Related U.S. Application Data

(60) Provisional application No. 61/438,563, filed on Feb. 1, 2011.

(51) Int. Cl.
*H01R 29/00* (2006.01)

(52) U.S. Cl.
USPC ..... 439/140

(58) Field of Classification Search
USPC ..... 439/140, 141, 188, 369, 137, 145; 200/51.09, 51.1
See application file for complete search history.

(56) References Cited

U.S. PATENT DOCUMENTS

| | | | | | |
|---|---|---|---|---|---|
| 4,179,175 | A * | 12/1979 | Farnworth et al. | 439/140 |
| 4,230,386 | A * | 10/1980 | Farnworth et al. | 439/188 |
| 4,425,486 | A * | 1/1984 | Ballman | 200/51 R |
| 4,652,067 | A * | 3/1987 | Lutzenberger | 439/43 |
| 5,112,237 | A * | 5/1992 | Yang | 439/188 |
| 5,374,199 | A * | 12/1994 | Chung | 439/188 |
| 5,551,884 | A * | 9/1996 | Burkhart, Sr. | 439/140 |
| 6,080,004 | A * | 6/2000 | Kovacik et al. | 439/369 |
| 6,875,040 | B1 * | 4/2005 | O'Keefe et al. | 439/346 |
| 6,981,888 | B2 * | 1/2006 | O'Keefe et al. | 439/369 |
| 7,537,468 | B1 * | 5/2009 | Huang et al. | 439/135 |
| 7,901,230 | B1 * | 3/2011 | Lo | 439/188 |
| 8,491,321 | B2 * | 7/2013 | Kobayashi | 439/181 |
| 2002/0098729 | A1 * | 7/2002 | Conrad et al. | 439/188 |
| 2003/0085108 | A1 * | 5/2003 | Chiang et al. | 200/51.09 |
| 2010/0029111 | A1 * | 2/2010 | Yuba et al. | 439/188 |
| 2011/0117762 | A1 * | 5/2011 | Beak et al. | 439/188 |
| 2012/0142204 | A1 * | 6/2012 | Eberhard et al. | 439/188 |

* cited by examiner

*Primary Examiner* — Gary Paumen
(74) *Attorney, Agent, or Firm* — Alan I. Cantor; Mark S. Bicks; Alfred N. Goodman

(57) ABSTRACT

An electrical plug assembly may include a body having a plurality of electrical contact blades and an actuator. In particular embodiments, the plug assembly includes a shield member having a back and a front. The back has an opening arranged to receive the body therein and the front has a plurality of openings, wherein each opening is shaped, sized, and aligned with a respective one of the plurality of contact blades of the body. In a particular embodiment, the plug assembly further includes a biasing member positioned between the body of the plug and the back side of the shield member to operatively interact with the shield member to prevent electrical current flow and during operation the shield member may slide over the body and operatively engage the actuator to allow electrical current flow.

18 Claims, 9 Drawing Sheets

TAMPER RESISTANT ELECTRICAL PLUG

CROSS REFERENCE TO RELATED APPLICATIONS

This Application claims the benefit of the filing date of U.S. Provisional Patent Application 61/438,563 to Shotey et al. entitled "Tamper Resistant Electrical Plug" which was filed on Feb. 1, 2011, the disclosure of which is hereby incorporated herein by reference.

BACKGROUND

1. Technical Field

Aspects of the present disclosure relate to electrical plugs that selectively restrict and permit electrical plugs to be inserted into electrical receptacles and for electrical receptacles to provide electricity to the plugs.

2. Background Art

A number of tamper resistant electrical plugs are known to include various methods of preventing a child or user from receiving an electrical shock. Previous safety plugs have included accordion style outer coverings and retractable covers that utilize a shield housing that encompasses the electrical plug blades, either individually or as a complete unit. For the accordion style outer covering, an insulator material capable of being repeatedly collapsed in an accordion fashion without cracking or losing its resilience is required. In addition, the external accordion sheath requires extra-long prongs to accommodate for the collapsed shielding material that compiles at the base of the prongs. This can destabilize the seating of the electrical plug and the added length of the prongs provides an additional danger during plugging and unplugging resulting from additional instability in the structure of the plug.

SUMMARY

This disclosure includes one or more electrical devices with tamper resistant members which improve user safety by preventing access to the electrical contacts by users.

A particular aspect broadly includes an electrical plug assembly comprising a body having at least one actuator. The body further comprises a front having a plurality of electrical contact blades. The plug assembly also includes a shield member having a back and a front. The back also has an opening arranged to receive the body therein and the front has a plurality of openings, wherein each opening is shaped, sized, and aligned with a respective one of the plurality of contact blades of the body. The plug assembly further includes a biasing member between the body and the back side of the shield member, biasing the shield member away from the body toward a first position. The shield member is positionable between the first position and a second position through movement of the shield member over the body to operatively engage the at least one actuator. The shield member presses against each of the at least one actuator which presses against at least one of the plurality of electrical contact blades when the shield member is in the second position and completes an electrical connection between the at least one of the plurality of electrical contact blades and an electrical cord, and the shield member releases the actuator and discontinues the electrical connection between the at least one of the plurality of electrical contact blades and the electrical cord when the shield member is in the first position.

In particular implementations, the plug assembly may also include a cord wherein during operation the shield member may slide over the body and operatively engage the actuator to allow electrical current flow from an electrical source through the electrical contact blades and the cord.

In additional particular implementations, the biasing mechanism may be a spring. The body may also have a mount and the spring engages the mount. The body and the shield member may be biased apart. The biasing member may be a spring located between the body and the shield member.

In further implementations, the shield member may be shaped and sized slightly larger than the body so that the shield may slide over the body during operation. The actuator may include a pair of actuating tabs with one actuating tab on each side of the body of the plug. During operation the shield member may compress the pair of actuating tabs allowing electrical current flow through the plug. The pair of actuating tabs may be angled outward from the body.

In an implementation, the body further comprises a first side and a second side and the at least one actuator comprises a pair of actuating tabs with one actuating tab located on each of the first side and the second side of the body of the plug.

In a particular implementation, the shield member simultaneously compresses the pair of actuating tabs while moving from the first position to the second position.

In an implementation, the pair of actuating tabs is angled outward from the body.

In another implementation, each of the pair of actuating tabs comprises a first side and a second side. The first side has an angled surface. The shield member is adapted to slide along the angled surface when the shield member moves over the body toward the second position. The pair of actuating tabs are pivotably coupled to the body, the pair of actuating tabs positionable between a first position and a second position through movement of the shield member over the body.

In another implementation, the body further comprises a plurality of internal contact blades each corresponding to one of the plurality of contact blades. The plurality of internal contact blades are each electrically coupled with the electrical cord, wherein movement of the blade shield along the angled surface of each of the pair of actuating tabs as the blade shield moves over the body pivots each of the pair of actuating tabs into contact with the respective one of the plurality of contact blades which moves each of the plurality of contact blades into electrical contact with the respective one of the plurality of internal contact blades.

Each of the plurality of internal contact blades has a contact tab and each of the plurality of the contact blades has a contact tab. Movement of the blade shield along the angled surface of each of the pair of actuating tabs as the blade shield moves over the body pivots each of the pair of actuating tabs into contact with the respective one of the plurality of contact blades which moves each of the contact tabs of the plurality of contact blades into electrical contact with the respective contact tab of each of the plurality of internal contact blades.

In an implementation, the plug is changed from a no current flow state when the pair of actuating tabs are in the first position to a current flow state when the pair of actuating tabs are in the second position in response to engagement of the actuating tabs by the shield member.

In a particular implementation, the plug is changed from a no current flow state to a current flow state in response to engagement of the at least one actuator by the shield member.

Another particular aspect may broadly include an electrical plug adapter comprising a frame having a front side and a back side. The front side has adapter contacts and the back side comprises a pair of slots located near a periphery of the frame and a plurality of contact blade openings located inward of the slots. The adapter also includes a blade shield sized and arranged to partially cover the front side of the frame. The blade shield also has a plurality of apertures in a front face arranged to permit the adapter contacts of the frame to extend therethrough. The adapter also includes a locking ring comprising a cord slot and a pair of arms, each arm arranged to removably engage a respective one of the pair of slots in the frame, and a pair of release buttons extending through a surface of the frame. The buttons may be positioned adjacent to the slots in the frame to release the arms of the locking ring from the slots in the frame when the buttons are depressed.

In particular implementations, each of the pair of arms further comprises a plurality of teeth, wherein at least one of the plurality of teeth on each arm engages a pawl in each of the slots. Each of the pair of release buttons operatively engages the respective pawl in each slot to release the arms of the locking ring from the slots in the frame. The pawl may have an angled surface on a first side adapted to slide along and pass an angled surface on the plurality of teeth when the arm is inserted into the slot, and restricts movement of the arm by engaging a surface of a first tooth of the plurality of teeth when the arm is withdrawn from the slot unless the pair of release buttons is actuated.

In particular implementations, the blade shield further comprises an opening in the back sized and arranged to receive the frame therein permitting the blade shield to slide over the frame so that the adapter contacts of the frame extend through the plurality of apertures in the blade shield. Movement of the blade shield is limited to the blade shield contacting the front side of the frame.

A particular aspect may include an electrical receptacle having electrical contacts therein. The receptacle may include a front surface having a plurality of blade apertures configured to receive contact blades of an electrical plug. The receptacle may also include a plurality of shutters between the front surface and the electrical contacts. The plurality of shutters correspond to the plurality of blade apertures and selectively restricting and permitting access to the electrical contacts therein. The receptacle may also include a button extending through the front surface operatively coupled to the plurality of shutters to open the plurality of shutters when the button is pressed.

In a particular implementation, the button may be positionable between a first position and a second position. The button presses against the electrical contacts in the receptacle when the button is in the second position and completes an electrical connection between the electrical contacts and an electrical cord. The button separates from the internal contacts and discontinues the electrical connection between the electrical contacts and the electrical cord when the button is in the first position.

Another aspect may include an electrical plug assembly including a plug having a body. The body may include electrical contact blades extending from the body and an actuating pin between the blades. The assembly may also include an electrical receptacle having a front surface with a plurality of blade apertures configured to receive the contact blades of the electrical plug and an actuating aperture configured to receive the actuating pin of the plug.

In an implementation, the actuating pin is configured to actuate the electrical receptacle to enable current flow when the actuating pin is inserted into the actuating aperture.

BRIEF DESCRIPTION OF THE DRAWINGS

Features of particular aspects and implementations of tamper resistant electrical devices will hereinafter be described in conjunction with the appended drawings, where like designations denote like elements, and.

DETAILED DESCRIPTION

There is a variety of embodiments and implementations of tamper resistant electrical plugs disclosed herein.

Figure 1:
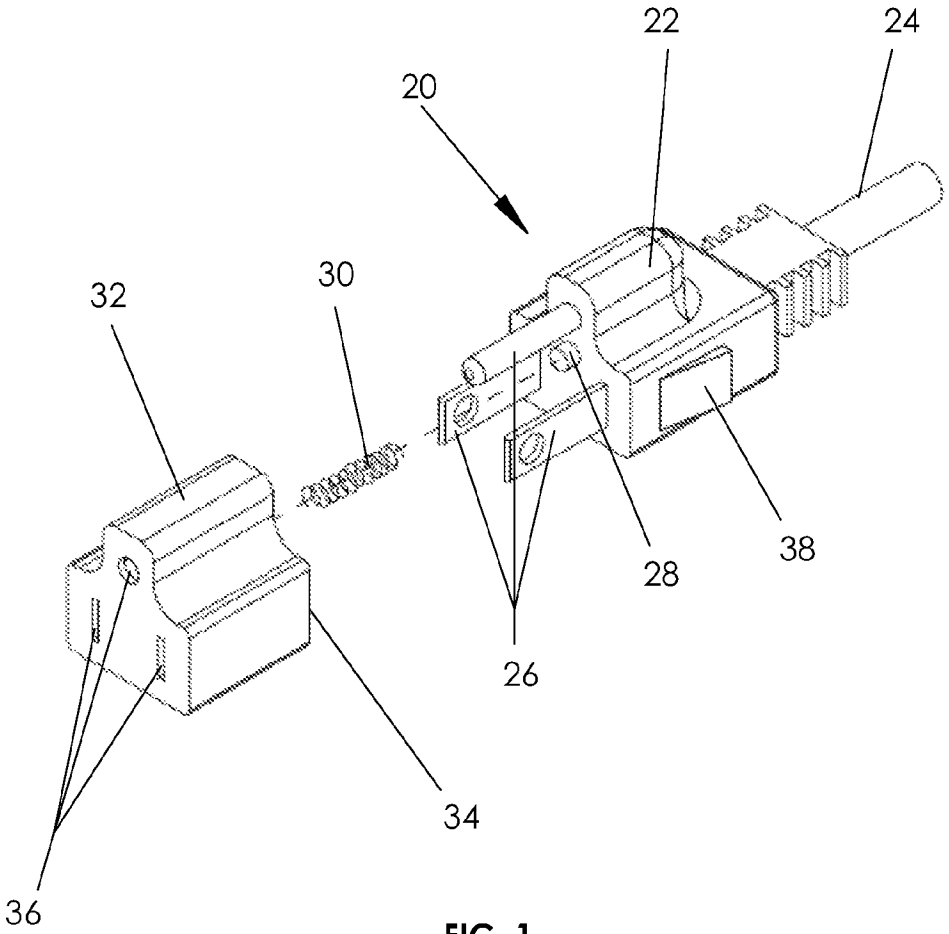
FIG. 1 is an exploded perspective view of a tamper resistant plug with actuating tabs on two sides.
Figure 2:
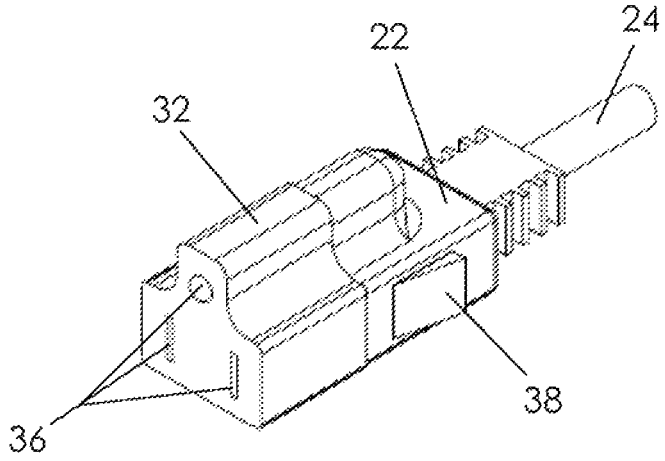
FIG. 2 is a perspective view of a tamper resistant plug with a shield partially located on the plug.
Figure 3:
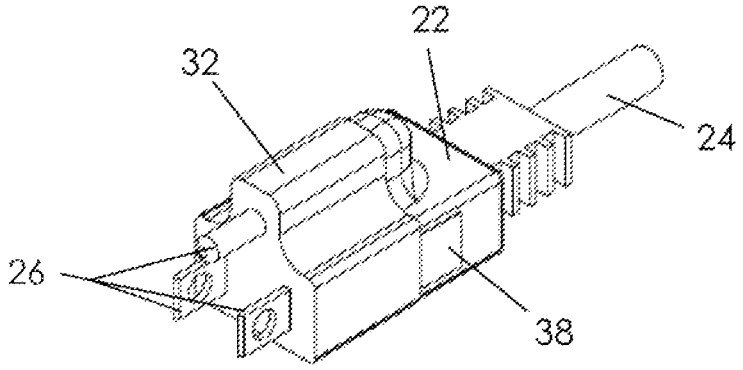
FIG. 3 is a perspective view of a tamper resistant plug with a shield pushed back to actuate the tabs.
Figure 4:
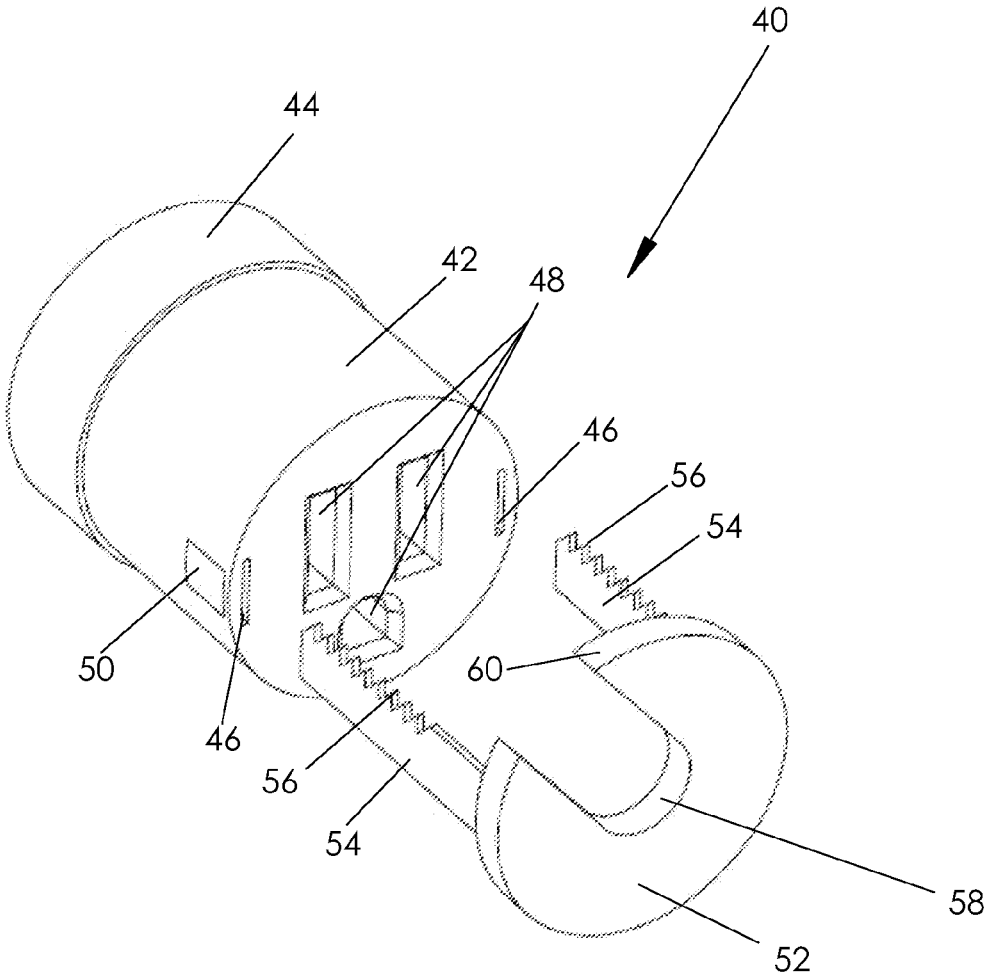
FIG. 4 is a perspective view of a tamper resistant plug adapter with a locking ring removed.

FIGS. 1-3 illustrate a tamper resistant electrical plug 20 having a body 22 and a cord 24. Body 22 includes a plurality of electrical contact blades 26 and a spring mount 28 between blades 26. A spring 30 is mounted on spring mount 28 and interacts with shield member 32, which is advantageously shaped and sized slightly larger than plug body 22 so that the shield 32 may slide over the body 22 during operation. Shield member 32 includes an opening 34 in the back which is arranged to receive body 22 therein and a plurality of openings 36 each shaped, sized, and aligned with a respective contact blade 26.

Body 22 also includes a pair of actuating tabs 38, with one actuating tab on each side of the plug. Tabs 38 are preferably angled outward and are compressed to the closed position as shield member 32 is forced backwards onto body 22. During this movement, shield member 32 moves backward on the plug 20 to expose the plug blades 36 and compresses spring 30. In the fully inserted position (FIG. 3), actuating tabs 38 are fully compressed completing the electrical circuit between the cord 24 and the blades 26, and permit electrical current to pass therethrough. Greater detail of the operation of an implementation of the plug is described below with reference to FIGS. 12A and 12B. Once the electrical plug is removed from the outlet, spring 30 forces shield member 32 away from body 22, thereby decompressing actuating tabs 38 and cutting off the power supply (FIG. 2).

FIGS. 4-7 illustrate an implementation of a tamper resistant electrical plug adapter 40 which may be added to a standard electrical plug or pre-installed on any number of electrical plugs. Adapter 40 includes a frame 42 and a blade shield 44. Blade shield 44 is slightly wider than frame 42 so that the shield can slide over frame 42 and the blade shield movement is limited to the blade shield contacting the front side of frame 42. On a back side of frame 42, a pair of slots 46 are located near the periphery of the frame 42, while a plurality of contact blade openings 48 are located inward of slots 46. Blade openings 48 are shaped, sized, and positioned so that a standard electrical plug blade can be inserted therein. Frame 42 also includes a pair of release buttons 50 aligned with slots 46. Adapter 40 also includes a locking ring 52 having a pair of arms 54 each having teeth 56. The locking ring 52 may also include a cord slot 58 extending from a plug contact surface 60 to a rear surface.

Figure 5A:
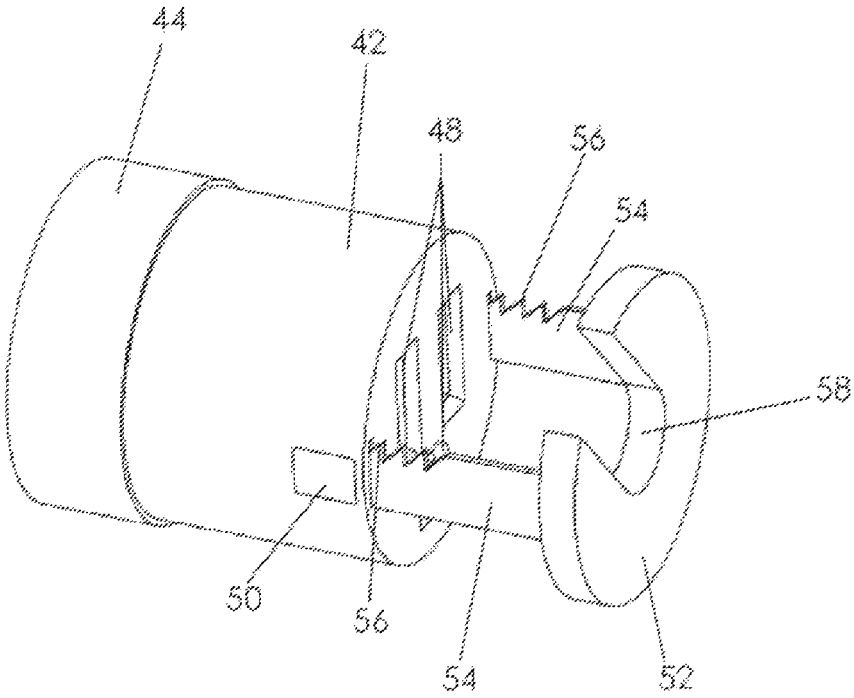
FIG. 5A is a perspective view of a tamper resistant plug adapter with a locking ring partially installed.
Figure 5B:
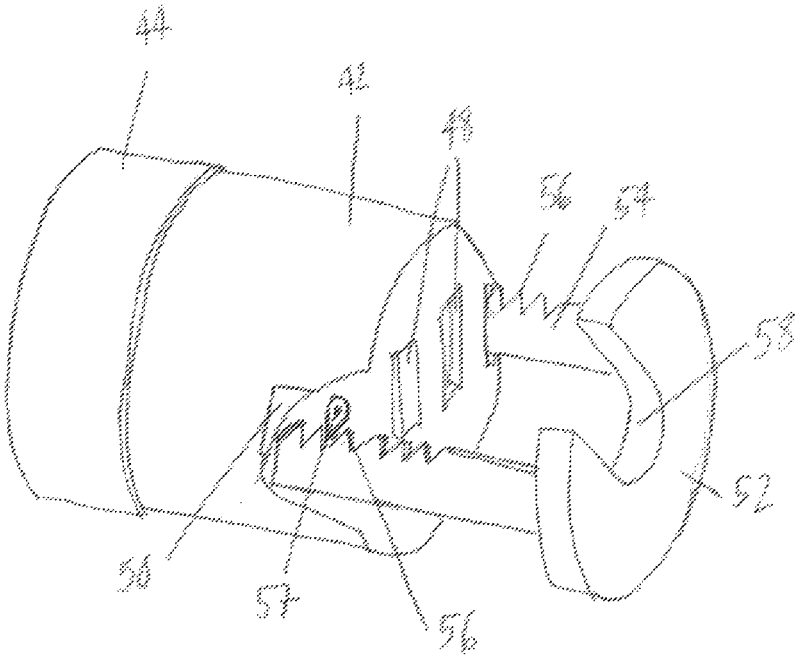
FIG. 5B is a partial cut-away perspective view of a tamper resistant plug adapter with a locking ring partially installed.

As best seen in FIGS. 5A and 5B, locking ring 52 is removably mounted to frame 42 through slots 46. Namely, each arm 54 is inserted into a respective slot 46 and teeth 56 engage a pawl 57 within each slot 46 that are connected to release buttons 50. Thus, teeth 56 prevent the locking ring 52 from being pulled out of the frame 42 unless release buttons 50 are compressed. When compressed, the release buttons 50 respectively engage the pawls 57 to disengage the pawls 57 from the teeth 56 on each arm 54.

Figure 6:
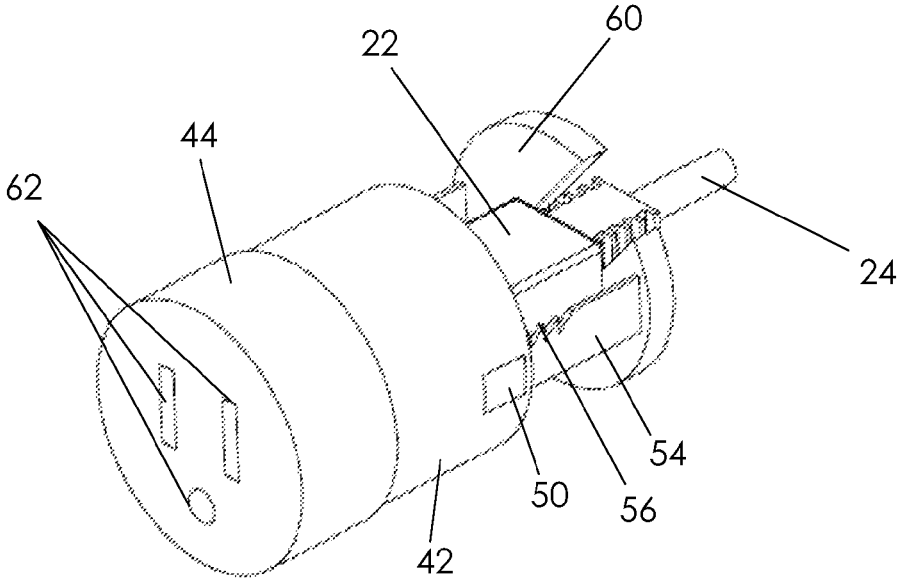
FIG. 6 is a perspective view of a tamper resistant plug adapter with a plug mounted therein.
Figure 7:
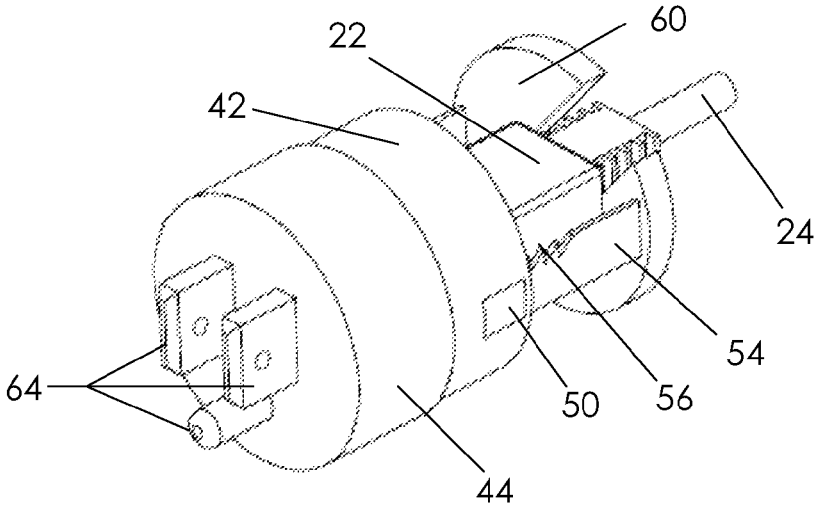
FIG. 7 is a perspective view of a tamper resistant plug adapter with a plug mounted therein and a blade shield partially refracted.

Referring to FIGS. 6 and 7, an electrical plug 20 is installed into the back of adapter 40 and locking ring 52 is moved forward until it securely contacts a rear portion of the electrical plug 20 and cord 24 is aligned with cord slot 58. Accordingly, the body 22 of the plug 20 is then held in place securely between frame 42 and locking ring contact surface 60. The blade shield 44 also includes a plurality of apertures 62 on a front side arranged to permit adapter contacts 64 to extend therethrough. In an implementation the blade shield 44 is normally biased away from the frame 42. This biasing position protects the user from touching the adapter contacts 64. During operation, the front surface of blade shield 44 contacts the receptacle and frame 42 is moved within the blade shield 44 toward the receptacle, thereby exposing adapter contacts 64 through apertures 62 and allowing electrical current to pass from the electrical receptacle, through the adapter, and ultimately to the electrical plug. To remove the electrical plug from adapter 40, the user simply compresses release buttons 50 and pulls back on locking ring 52.

Figure 8:
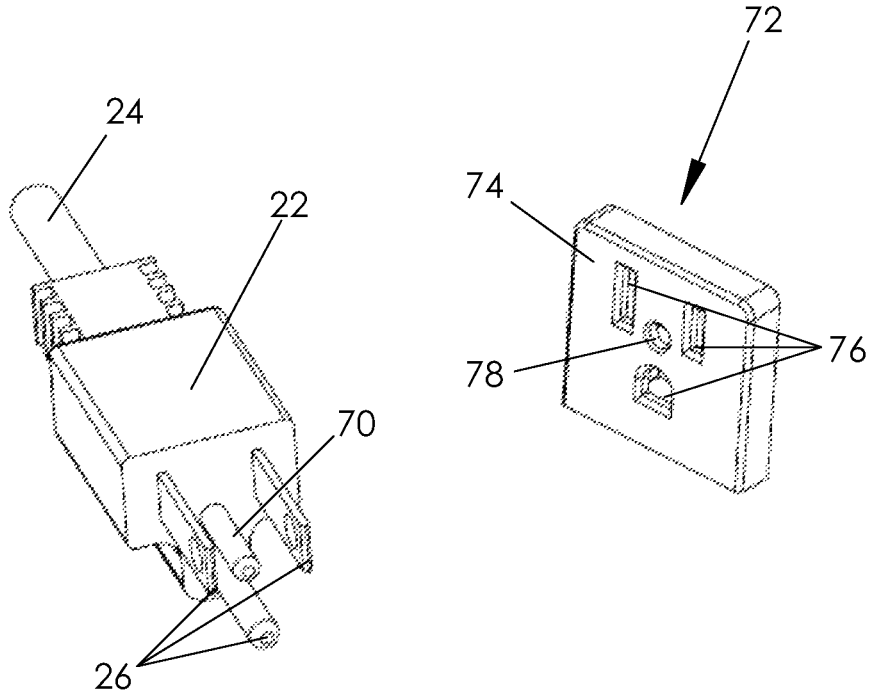
FIG. 8 is a view of a tamper resistant electrical plug with an actuating prong and an electrical receptacle having an actuating aperture arranged to receive the actuating prong.
Figure 9:
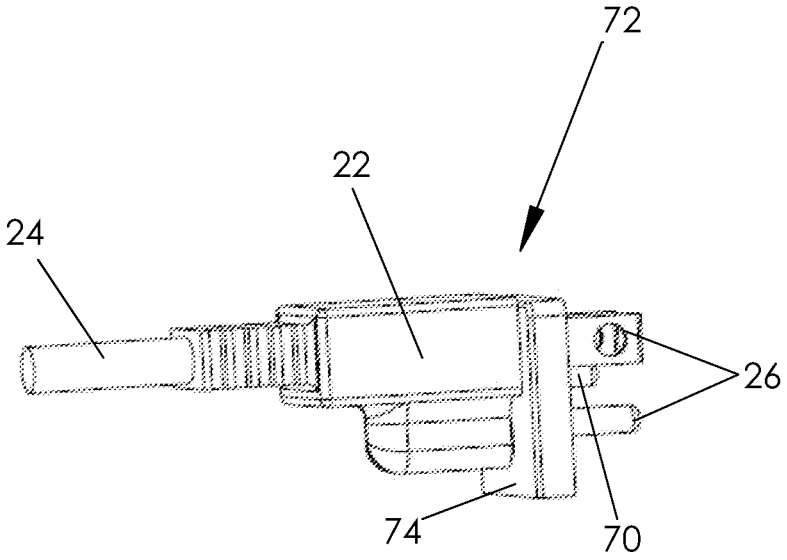
FIG. 9 is a view of a tamper resistant electrical plug with the actuating prong inserted into the actuating aperture.

FIGS. 8-9 illustrate an implementation of a plug having a body 22 and a cord 24 with blades 26 extending from body 22. An actuating pin 70 is located between blades 26 on body 22 and may be the same length as, shorter than, or longer than blades 26 without departing from the spirit and scope of the disclosure.

Similarly, electrical device face 72 of an electrical device includes a front surface 74 with a plurality of blade apertures 76 arranged to receive blades 26 of the electrical plug. Electrical devices of various types are known in the art and may be used. For clarity, the particular electrical device is not shown here. Although just the face of the receptacle is shown, the receptacle includes components known in the art to provide electrical current to electrical contacts positioned behind the face. The electrical device face 72 is configured to receive the corresponding plug. In addition, an actuating aperture 78 may be located between apertures 76 on the device face 72. As can be seen in FIG. 9, blades 26 and actuating pin 70 are inserted through blade apertures 76 and actuating aperture 78, respectively.

When the actuating pin 70 extends through the actuating aperture 78, the actuating pin 70 advances into the internal portion of the electrical device through the actuating aperture 78 causing electrical contact of internal electrical contacts to electrically energize the apertures 76 for enabling current flow through the contact blades 26 of the plug.

During insertion, the actuating pin 70 enters into the actuating aperture 78 until it reaches the fully inserted position (see FIG. 9) permitting electrical current to pass therethrough. Once the electrical plug is removed from the electrical device, when the plug pulls out from the receptacle a little bit, the shorter actuating pin 70 disengages from the internal electrical contacts, thereby breaking the circuit and cutting off the supply of electrical current from the receptacle. This discontinues the flow of current to protect the user from contacting the live plug blades if the plug partially disengages from the receptacle.

Figure 11:
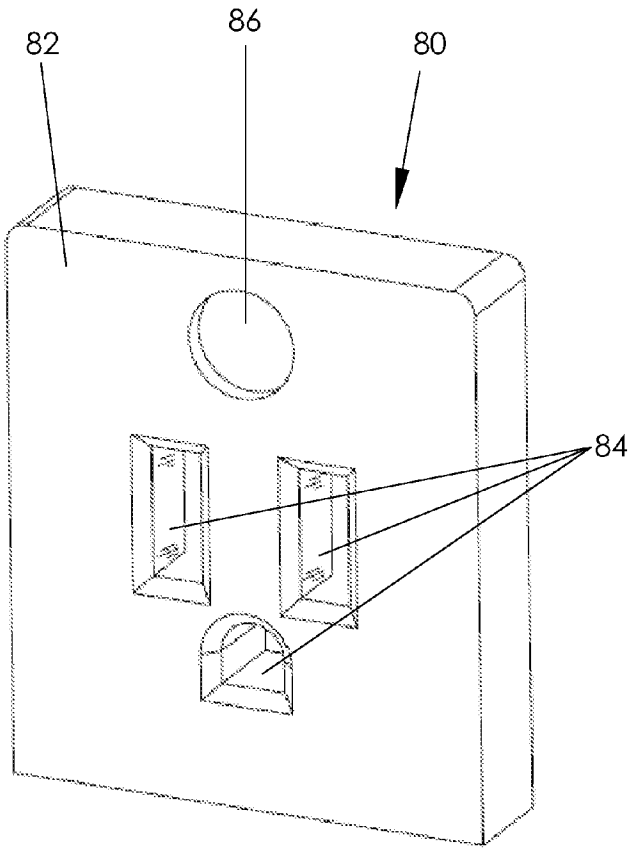
Figure 10:
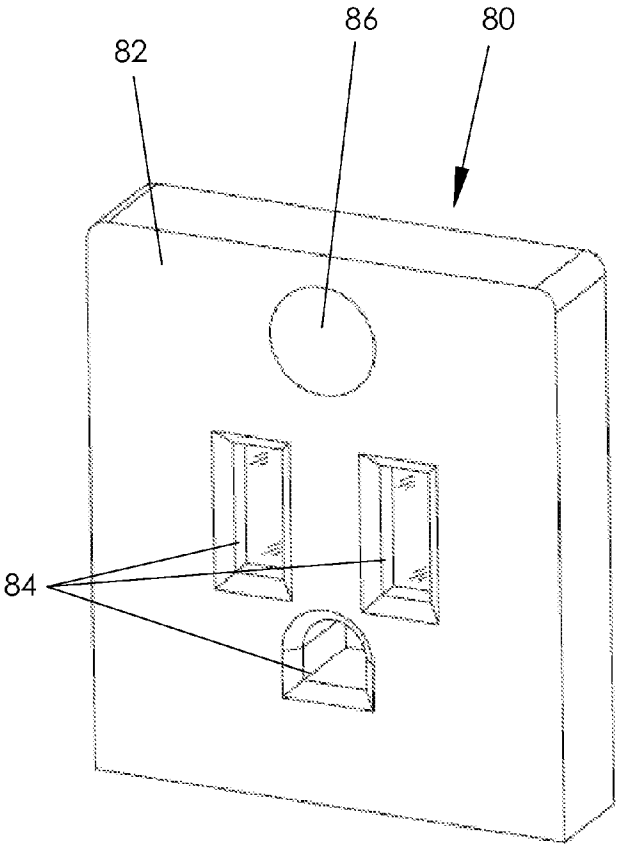
FIG. 10 is a view of an electrical receptacle with a shutter system in the closed position and a bypass button; and, FIG. 11 is a view of an electrical receptacle with a shutter system in the open position and the bypass button depressed.

FIGS. 10 and 11 illustrate a portion of an implementation of an electrical receptacle. The receptacle includes components known in the art to provide electrical current to electrical contacts positioned behind the face of the receptacle. Face 80 has a front surface 82 with a plurality of shutters 84 selectively permitting access to the electrical contacts therein. In one aspect, the user pushes a button 86 to open the shutters 84 so that the user can insert an electrical plug. The shutters 84 remain open until the electrical plug is removed. In operation, button 86 may also selectively operate the flow of electrical current so that when a plug is installed, the user may compress button 86 to permit current to flow until button 86 is once again compressed. In still another aspect, button 86 must be compressed in order for an electrical plug to be inserted. Specifically, shutters 84 may restrict access unless button 86 is compressed, but shutters 84 may not open until an electrical plug forces them open.

Figure 12A:
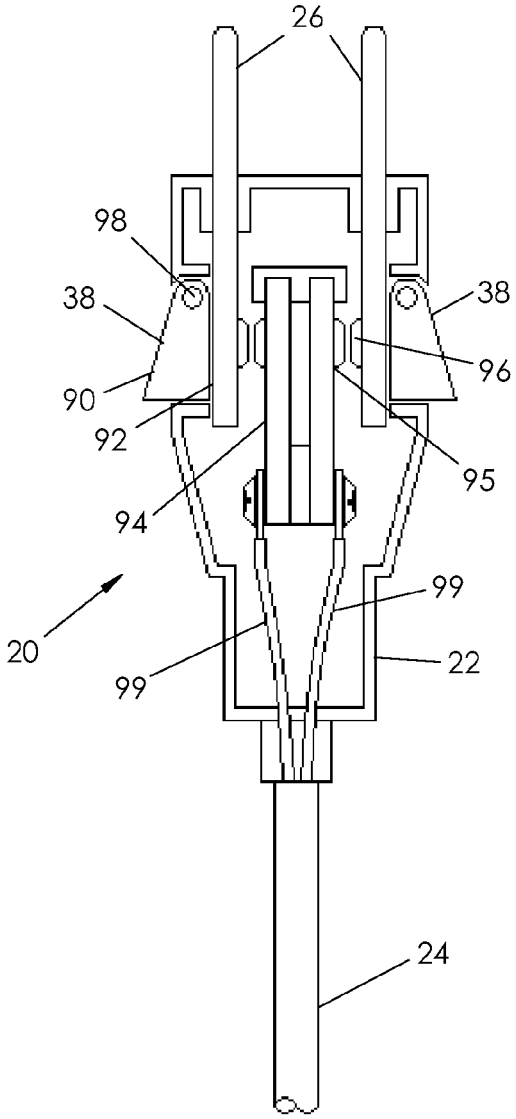
FIGS. 12A and 12B illustrate cross sectional views of an implementation of a tamper resistant electrical plug shown in FIGS. 1-3.
Figure 12B:
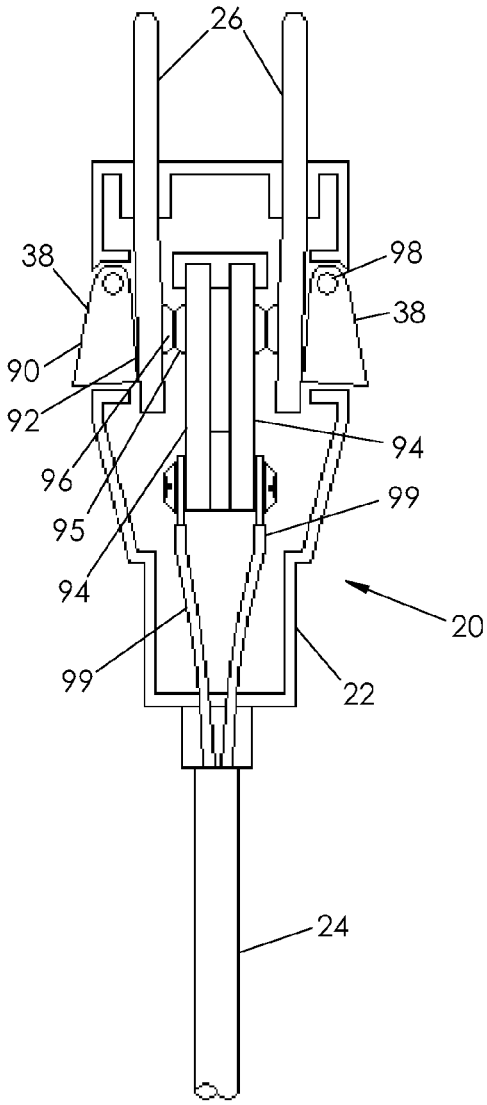

FIGS. 12A and 12B illustrate cross sectional views in greater detail of an implementation of a tamper resistant electrical plug 20 shown in FIGS. 1-3. The plug 20 includes the body 22 and electrical contact blades 26. Body 22 also includes the pair of actuating tabs 38, with one actuating tab on each side of the plug. The actuating tabs 38 are preferably angled outward having an angled surface 90 and a contact surface 92. Within the body 22 of the plug 20 are internal electrical blades 94 with contact pads 95. The electrical contact blades 26 also have contact pads 96.

During operation, the shield member 32 (not shown in FIGS. 12A and 12B) is forced backwards onto the body 22 so that the shield member 32 slides along the angled surface 90 of the actuating tabs 38 causing them to pivot about a pivot point 98. As the shield member 32 advances along the angled surface 90, the pivoting movement of the actuating tabs 38 causes the contact surface 92 to impinge upon the contact blade 26. This pivoting movement of the actuating tabs 38 causes the contact pads 96 on the contact blades 26 to electrically contact the contact pads 95 on the internal electrical blades 94. This electrical contact will allow electrical current to flow from an electrical power source into the contact blades 26 through the internal electrical blades 94 and through electrical wires 99 which are connected to the internal electrical blades 94 and travel through the cord 24.

Specifically, FIG. 12A illustrates a first position of the actuating tabs 38 wherein no contact is being made between the contact blades 26 and the internal contact blades 94. No complete circuit for the flow of electrical current is provided in this first position. This first position illustrated in FIG. 12A corresponds to the relative positions of the body 22 and the shield member 32 shown in FIG. 2.

FIG. 12B illustrates a second position of the actuating tabs 38 which does allow electrical current flow. This second position illustrated in FIG. 12B corresponds to the relative positions of the body 22 and the shield member 32 shown in FIG. 3. A complete electrical circuit is created when the pivoting movement of the actuating tabs 38 causes the contact surfaces 92 to respectively impinge upon the contact blades 26 thereby resulting in the contact pads 96 on the contact blades 26 electrically contacting the contact pads 95 on the internal electrical blades 94. This electrical contact will allow electrical current to flow from an electrical power source into the contact blades 26 through the internal electrical blades 94 and through electrical wires 99 which are connected to the internal electrical blades 94 and travel through the cord 24.

During the movement of the shield member 32 over the body 22, the shield member 32 also compresses the spring 30 until it reaches the fully inserted position (see FIG. 3). The actuating tabs 38 are compressed and rotated to permit electrical current to pass therethrough. Once the electrical plug 20 is removed from the outlet, spring 30 forces shield member 32 away from body 22, thereby decompressing the actuating tabs 38 so that they pivot causing the contact pads 95 on the internal blades 94 and the contact pads 96 on the contact blades 26 to separate from each other, thereby breaking the circuit and cutting off the supply of electrical current.

In these and in any other aspects, the tamper resistant electrical plug may be made of any materials and fabricated and/or assembled in any manner. For instance the tamper resistant electrical plug may be manufactured from various different pieces and then screwed or glued together.

It will be understood that implementations are not limited to the specific components disclosed herein, as virtually any components consistent with the intended operation of a method and/or system implementation for a tamper resistant electrical plug may be utilized. Components may comprise any shape, size, style, type, model, version, class, grade, measurement, concentration, material, weight, quantity, and/or the like consistent with the intended operation of a method and/or system implementation for a tamper resistant electrical plug. Implementations are not limited to uses of any specific components, provided that the components selected are consistent with the intended operation of a method and/or system implementation for a tamper resistant electrical plug.

Accordingly, the components defining any tamper resistant electrical plug implementation may be formed of any of many different types of materials or combinations thereof that can readily be formed into shaped objects provided that the components selected are consistent with the intended operation of a tamper resistant electrical plug implementation. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any tamper resistant electrical device implementation may be purchased premanufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld (e.g. an ultrasonic weld), a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The implementations listed here, and many others, will become readily apparent from this disclosure. From this, those of ordinary skill in the art will readily understand the versatility with which this disclosure may be applied.

The invention claimed is:

1. An electrical plug assembly comprising:

a body comprising at least one actuator, the body further comprising a front having a plurality of electrical contact blades;

a shield member comprising a back and a front, the back comprising an opening sized and shaped to receive the body therein permitting the shield member to slide over the body, and the front comprising a plurality of openings, wherein each opening is shaped, sized, and aligned with a corresponding one of the plurality of electrical contact blades of the body;

a biasing member between the body and the back side of the shield member, biasing the shield member away from the body toward a first position, the shield member positionable between the first position and a second position through movement of the shield member over the body to operatively engage the at least one actuator, wherein the shield member presses against each of the at least one actuator which presses against at least one of the plurality of electrical contact blades when the shield member is in the second position and completes an electrical connection between the at least one of the plurality of electrical contact blades and an electrical cord, and the shield member releases the actuator and discontinues the electrical connection between the at least one of the plurality of electrical contact blades and the electrical cord when the shield member is in the first position.

2. The plug assembly of claim 1 wherein the body further comprises a first side and a second side and the at least one actuator comprises a pair of actuating tabs with one actuating tab located on each of the first side and the second side of the body of the plug.

3. The plug assembly of claim 2 wherein the shield member simultaneously compresses the pair of actuating tabs while moving from the first position to the second position.

4. The plug assembly of claim 2 wherein the pair of actuating tabs are angled outward from the body.

5. The plug assembly of claim 2 wherein each of the pair of actuating tabs comprises a first side and a second side, the first side having an angled surface, wherein the shield member is adapted to slide along the angled surface when the shield member moves over the body toward the second position, and wherein the pair of actuating tabs are pivotably coupled to the body, the pair of actuating tabs positionable between a first position and a second position through movement of the shield member over the body.

6. The plug assembly of claim 5 the body further comprising a plurality of internal contact blades each corresponding to one of the plurality of contact blades, the plurality of internal contact blades each electrically coupled with the electrical cord, wherein movement of the blade shield along the angled surface of each of the pair of actuating tabs as the blade shield moves over the body pivots each of the pair of actuating tabs into contact with the respective one of the plurality of contact blades which moves each of the plurality of contact blades into electrical contact with the respective one of the plurality of internal contact blades.

7. The plug assembly of claim 6 wherein each of the plurality of internal contact blades has a contact tab and each of the plurality of the contact blades has a contact tab, wherein movement of the blade shield along the angled surface of each of the pair of actuating tabs as the blade shield moves over the body pivots each of the pair of actuating tabs into contact with the respective one of the plurality of contact blades which moves each of the contact tabs of the plurality of contact blades into electrical contact with the respective contact tab of each of the plurality of internal contact blades.

8. The plug assembly of claim 5 wherein the plug is changed from a no current flow state when the pair of actuating tabs are in the first position to a current flow state when the pair of actuating tabs are in the second position in response to engagement of the actuating tabs by the shield member.

9. The plug assembly of claim 1 wherein the plug is changed from a no current flow state to a current flow state in response to engagement of the at least one actuator by the shield member.

10. The plug assembly of claim 1 wherein the biasing mechanism comprises a spring.

11. The plug assembly of claim 10 wherein the front of the body further comprises a mount and the spring is coupled to the mount.

12. An electrical plug adapter comprising:

a frame comprising a front side and a back side, the front side comprising adapter contacts and the back side comprising:

a pair of slots located near a periphery of the frame;

a plurality of contact blade openings located inward of the slots;

a blade shield sized and arranged to partially cover the front side of the frame, the blade shield further comprising a plurality of apertures in a front face arranged to permit the adapter contacts of the frame to extend therethrough;

a locking ring comprising a cord slot and a pair of arms, each arm arranged to removably engage a respective one of the pair of slots in the frame; and a pair of release buttons extending through a surface of the frame, the buttons positioned adjacent to the slots in the frame to release the arms of the locking ring from the slots in the frame when the buttons are depressed.

13. The plug adapter of claim 12 wherein each of the pair of arms further comprises a plurality of teeth, wherein at least one of the plurality of teeth on each arm engages a pawl in each of the slots, and each of the pair of release buttons operatively engages the respective pawl in each slot to release the arms of the locking ring from the slots in the frame.

14. The plug adapter of claim 13 wherein the pawl comprises an angled surface on a first side adapted to slide along and pass an angled surface on the plurality of teeth when the arm is inserted into the slot, and restricts movement of the arm by engaging a surface of a first tooth of the plurality of teeth when the arm is withdrawn from the slot unless the pair of release buttons is actuated.

15. The plug adapter of claim 12 wherein the blade shield further comprises an opening in the back sized and arranged to receive the frame therein permitting the blade shield to slide over the frame so that the adapter contacts of the frame extend through the plurality of apertures in the blade shield.

16. The plug adapter of claim 15 wherein movement of the blade shield is limited to the blade shield contacting the front side of the frame.

17. An electrical receptacle having electrical contacts therein, the receptacle comprising:

a front surface having a plurality of blade apertures configured to receive contact blades of an electrical plug;

a plurality of shutters between the front surface and the electrical contacts, the plurality of shutters corresponding to the plurality of blade apertures and selectively restricting and permitting access to the electrical contacts therein; and a button extending through the front surface for operating the plurality of shutters when the button is pressed.

18. The electrical receptacle of claim 17 wherein the button is positionable between a first position and a second position for completing an electrical connection within the receptacle when the button is in the second position and discontinuing the electrical connection within the receptacle when the button is in the first position.

* * * * *